US009538869B1

(12) United States Patent
Chang

(10) Patent No.: US 9,538,869 B1
(45) Date of Patent: Jan. 10, 2017

(54) HEIGHT-ADJUSTABLE PILLOW

(71) Applicant: MOTEX PRODUCTS CO., LTD., Bucheon-si, Gyeonggi-do (KR)

(72) Inventor: Sang Bin Chang, Seoul (KR)

(73) Assignee: Motex Products Co., Ltd. (KR)

( * ) Notice: Subject to any disclaimer, the term of this patent is extended or adjusted under 35 U.S.C. 154(b) by 0 days.

(21) Appl. No.: 15/255,473

(22) Filed: Sep. 2, 2016

Related U.S. Application Data

(63) Continuation of application No. PCT/KR2015/002002, filed on Mar. 2, 2015.

(30) Foreign Application Priority Data

Mar. 3, 2014 (KR) ..... 10-2014-0024858
Mar. 3, 2014 (KR) ..... 10-2014-0024859
Feb. 16, 2015 (KR) ..... 10-2015-0023432

(51) Int. Cl.
*A47G 9/10* (2006.01)

(52) U.S. Cl.
CPC ..... *A47G 9/1009* (2013.01); *A47G 9/10* (2013.01)

(58) Field of Classification Search
CPC ..... A47G 9/10; A47G 9/1009; A47G 9/109; A47C 7/383; A47C 7/38; A61G 13/12; A61G 13/1205; A61G 13/121; A61G 7/072; A61G 7/07
USPC .... 5/640, 636, 643, 630, 622, 621, 657, 652
See application file for complete search history.

(56) References Cited

U.S. PATENT DOCUMENTS 933,471 A * 9/1909 Leahy ..... A61G 13/121 5/637
2,239,003 A * 4/1941 Jones ..... A47G 9/1009 5/638
3,380,694 A * 4/1968 Branner ..... A47C 7/38 248/118
4,711,230 A * 12/1987 Berke ..... A61G 13/009 5/11
5,353,457 A * 10/1994 Chu ..... A47G 9/1009 5/640
5,983,427 A * 11/1999 Igei ..... A47G 9/1009 5/638
6,189,167 B1 * 2/2001 Tsai ..... A61G 7/0573 5/636
7,856,687 B2 * 12/2010 Chou ..... A47G 9/1009 5/636

(Continued)

FOREIGN PATENT DOCUMENTS

GB 2232880 A * 1/1991 ..... A47G 9/1009
KR 20-1990-0000332 Y1 1/1990

(Continued)

OTHER PUBLICATIONS

International Search Report (PCT/KR2015/002002), WIPO, May 26, 2015.

*Primary Examiner* — Robert G Santos
(74) *Attorney, Agent, or Firm* — Park & Associates IP Law, P. C.

(57) ABSTRACT

The present invention provides a height-adjustable pillow comprising: a lower member; an upper member which is disposed above the lower member, in such a way as to be able to move vertically relative to the lower member; and a raising and lowering device for adjusting the height of the upper member by moving the upper member.

5 Claims, 18 Drawing Sheets

(56) References Cited

U.S. PATENT DOCUMENTS

| | | | | |
|---|---|---|---|---|
| 2004/0128769 | A1* | 7/2004 | Azoulay | A47G 9/1009 5/640 |
| 2009/0276960 | A1* | 11/2009 | Chou | A47G 9/1009 5/640 |
| 2013/0025057 | A1* | 1/2013 | Tseng | A47G 9/1009 5/640 |

FOREIGN PATENT DOCUMENTS

| | | | |
|---|---|---|---|
| KR | 10-2001-0067979 | A | 7/2001 |
| KR | 10-2012-0002156 | A | 1/2012 |

* cited by examiner

HEIGHT-ADJUSTABLE PILLOW

REFERENCE TO RELATED APPLICATIONS

This is a continuation of pending International Patent Application PCT/KR2015/002002 filed on Mar. 2, 2015, which designates the United States and claims priority of Korean Patent Application No. 10-2014-0024858 filed on Mar. 3, 2014, Korean Patent Application No. 10-2014-0024859 filed on Mar. 3, 2014, and Korean Patent Application No. 10-2015-0023432 filed on Feb. 16, 2015, the entire contents of which are incorporated herein by reference.

FIELD OF THE INVENTION

The present invention relates generally to a pillow and, more particularly, to a height-adjustable pillow, the height of which is able to be adjusted.

BACKGROUND OF THE INVENTION

In general, a pillow serves to support the head of a user such that the user can remain in a comfortable position while sleeping, and thus generally has a predetermined height and a suitable cushioning function. Such a pillow includes a pillow body filled with a stuffing and a pillow cover covering the pillow body. The stuffing may be implemented as buckwheat chaff, rice chaff, latex, sponge, cotton, hair, a functional material, or the like.

People sleep in a variety of postures, i.e. people lie on backs, sides, or stomachs. When a person rests with the head supported on a pillow while lying on his or her back, the back of the head, the cervical spine, and the back are substantially in line, such that the user may not be significantly uncomfortable even if the height of the pillow used is relatively low. However, when the person attempts to sleep on the side with the pillow of the same height, the cervical spine becomes curved due to the difference in the height between one shoulder and one side of the face, causing the person to be uncomfortable. In contrast, when a relatively higher pillow is used, the person may feel relatively comfortable when lying on the side. However, when the person lies on his or her back, the head may be raised, whereby discomfort is likely.

SUMMARY OF THE INVENTION

Accordingly, the present invention has been made keeping in mind the above problems occurring in the related art, and the present invention is intended to propose a height-adjustable pillow, the height of which is able to be adjusted to a height at which a user can feel comfortable.

In order to achieve the above object, according to one aspect of the present invention, a height-adjustable pillow may include: a lower member; an upper member disposed on the lower member, the upper member being displaceable up and down with respect to the lower member; and a lifting unit adjusting a height of the upper member by displacing the upper member.

The lifting unit may include: a pair of driving shafts horizontally extending through the lower member; rotary gears disposed on the pair of driving shafts, a rotary gear on one of the driving shafts being meshed with a corresponding rotary gear on the other of the driving shafts; and lifting members disposed on the pair of driving shafts, wherein the lifting members lie in horizontal positions or are erected to vertical positions in response to rotation of the driving shafts to move the lifting members up and down.

One of the driving shafts may include a ratchet and a handle disposed thereon. The height-adjustable pillow may further include a stopper limiting free rotation of the ratchet to maintain the pair of driving shafts in a fixed position.

The stopper may be disposed on a support shaft horizontally extending through the base, and may be meshed with or unmeshed from the ratchet in response to a longitudinal movement of the support shaft. An elastic spring may be disposed between the stopper and the lower member to surround the support shaft, so that the support shaft is placed in a set position.

The lifting unit may include: a driving shaft horizontally extending through the lower member; bevel gears disposed on a front end of the driving shaft to convert longitudinal rotation of the driving shaft into lateral rotation; a driving gear section rotating in a lateral direction in concert with the bevel gears; a plurality of driven gear sections rotating in a lateral direction in concert with the driving gear section; and lifting portions disposed on top surfaces of the driven gear sections, each of the lifting portions including a plurality of step portions having different heights.

The plurality of step portions of each of the lifting portions may be formed in a stepwise manner with different heights, with slopes alternating with the step portions.

The upper member may have a plurality of contact members to be seated on corresponding step portions having same heights among the step portions of the lifting portions, so that the plurality of contact members are displaced up and down in response to rotation of the lifting portions.

The lifting unit may include: a rotary member provided on a surface of one of the lower member and the upper member that faces the other of the lower member and the upper member such that the rotary member is rotatable about a vertical axis, the rotary member including a slope upwardly inclined in one direction along a circumference thereof about the axis and a plurality of holding step portions formed on the slope to continuously extend along a length of the slope such that the plurality of holding step portions are positioned at different heights; and a contact member provided one the other one of the lower member and the upper member such that the contact member is able to come into contact with one of the plurality of holding step portions depending on an angle of rotation of the rotary member. Each of the plurality of holding step portions includes a stepped surface and a connecting surface, the stepped surfaces of the plurality of holding step portions are arranged at predetermined distances in the length of the slope such that the stepped surfaces are spaced apart and positioned at different heights from each other, and the connecting surfaces of the plurality of holding step portions are formed as inclined surfaces connecting the stepped surfaces having different heights, respectively, such that the contact member is displaced up and down along one of the connecting surfaces to move to an adjacent one of the stepped surfaces when the rotary member is rotated.

Each of the stepped surfaces may be downwardly inclined in one direction along the circumference about the axis.

The height-adjustable pillow may further include a guide for guiding upward and downward displacement of the upper member. The guide includes a guide pin and a pin-receiving member having a guide hole in which a guide pin is received. The guide pin is provided on one of the upper member and the lower member, and the pin-receiving member is provided on the other of the upper member and the lower member.

The height-adjustable pillow may further include an indicating unit for indicating a height of the upper member determined by the lifting unit. The indicating unit may include: a rack extending vertically downward from the upper member; a pinion meshed with the rack; and an indicating member disposed outside of the lower member to rotate along with the pinion, the indicating member having a height indicating portion.

According to embodiments of the present invention, the height of the pillow is able to be adjusted to a height at which a user can feel comfortable, so that the user is more likely to soundly sleep.

In particular, when the present invention is applied in facilities used by the public, customer satisfaction can be significantly improved, since every user can adjust the heights of a pillow according to his or her preference.

DETAILED DESCRIPTION OF THE INVENTION

Figure 1:
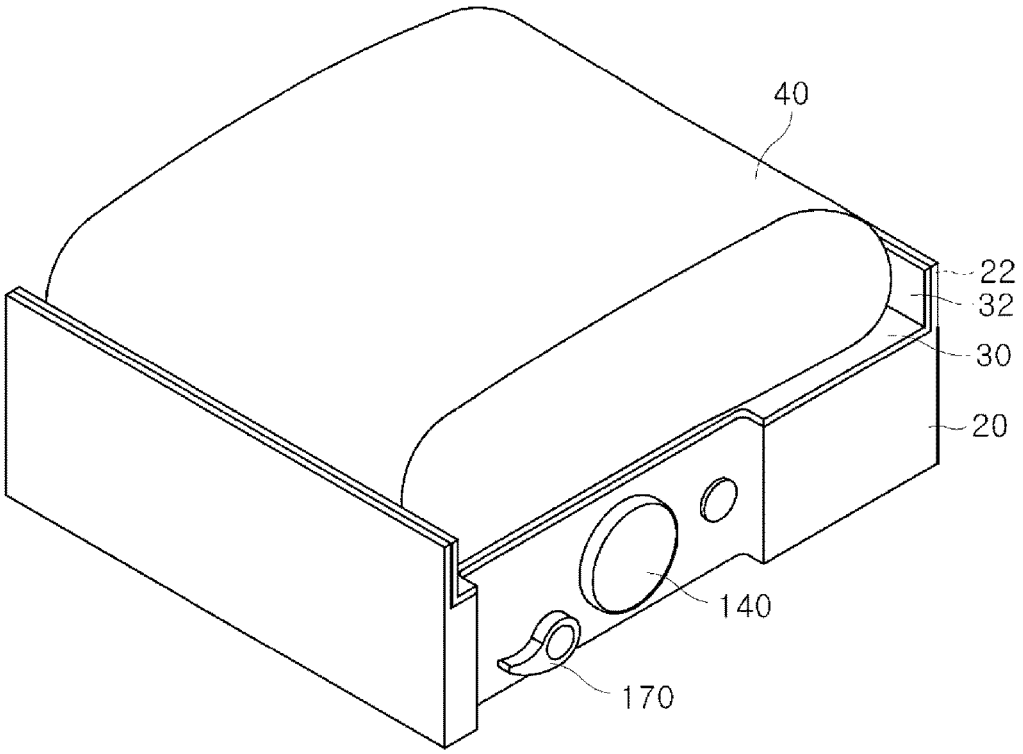
FIGS. 1 and 2 are a perspective view and a front elevation view illustrating a height-adjustable pillow according to a first exemplary embodiment of the present invention.

Hereinafter, exemplary embodiments of the present invention will be described with reference to the accompanying drawings.

First Embodiment

A height-adjustable pillow according to a first exemplary embodiment of the present invention is illustrated in FIGS. 1 to 11.

As illustrated in FIGS. 1 to 5, the height-adjustable pillow according to the first exemplary embodiment of the present invention includes a base 20, a cover 30, and a lifting unit 100. The base 20 is a lower member in the shape of a box with the top surface thereof being open. The cover 30 is an upper member seated on the base 20 such that the cover 30 can be displaced up and down. The lifting unit 100 displaces the cover 30 up and down with respect to the base 20. A cushion 40 is seated on the cover 30 to support the head. The cushion 40 is displaced up and down together with the cover 30 in response to the operation of the lifting unit 100.

As illustrated in FIGS. 4 to 11, the lifting unit 100 includes a pair of driving shafts 110 (112, 114) extending through the base 20 from the front end to the rear end (extending from the front to the rear), rotary gears 120 disposed on the pair of driving shafts 110 at predetermined distances, and lifting members 130 disposed on the pair of driving shafts 110 at predetermined distances.

The rotary gears 120 disposed on the first driving shaft 112 of the pair of driving shafts 110 mesh with the rotary gears 120 disposed on the second driving shaft 114 of the pair of driving shafts 110.

The lifting members 130 extend in one direction to be substantially elliptical, respectively having one end disposed on the first driving shaft 112 or the second driving shaft 114. That is, the lifting members 130 are disposed eccentrically. The lifting members 130 are disposed on the pair of driving shafts 110 such that the lifting members on one of the pair of driving shafts 110 oppose the lifting members on the other of the pair of driving shafts 110. Thus, the lifting members 130 remain in horizontal positions to be in parallel to each other or are rotated to vertical positions to be in parallel to each other. The detailed operational relationship will be described later.

A handle 140 is disposed on the front or rear end of one driving shaft of the pair of driving shafts 110, and ratchets 150 inclined in one direction are disposed on one driving shaft of the pair of driving shafts 110 on which the handle 140 is disposed. The plurality of ratchets 150 are provided in a number equal to the number of the lifting members 130 and are configured such that each of the ratchets 150 is in close contact with the corresponding lifting member 130. However, the number of the ratchets 150 is not limited to a specific number.

In the first embodiment of the present invention, for the sake of convenience, it will be described that the handle 140 is disposed on the front end of the first driving shaft 112 and the plurality of ratchets 150 are disposed on the first shaft 112.

Stoppers 160 are disposed in the inner space of the base 20 to engage with the ratchets 150 and maintain the ratchets 150 in fixed positions when the ratchets 150 are rotated. The stoppers 160 are disposed on a support shaft 162 extending through the base 20. Each of the stoppers 160 has an elastic member 160*a* extending from one portion thereof to maintain the fixed position. This imparts elasticity to the stopper 160 such that the stopper 160 rotates together with the support shaft 162 to a predetermined angle when external force having a predetermined intensity is applied thereto and then returns to the original position.

An elastic spring 164 surrounding the support shaft 162 is disposed between the front-most stopper of the stoppers 160 disposed on the support shaft 162 and the inner surface of the front end of the base 20. In addition, a lever 170 is disposed on the front end of the support shaft 162 to be exposed externally. The support shaft 162 moves in the front or back direction as the elastic spring 164 is compressed or restored in response to the lever 170 being pulled or the distal end of the support shaft 162 being pushed.

Figure 10:
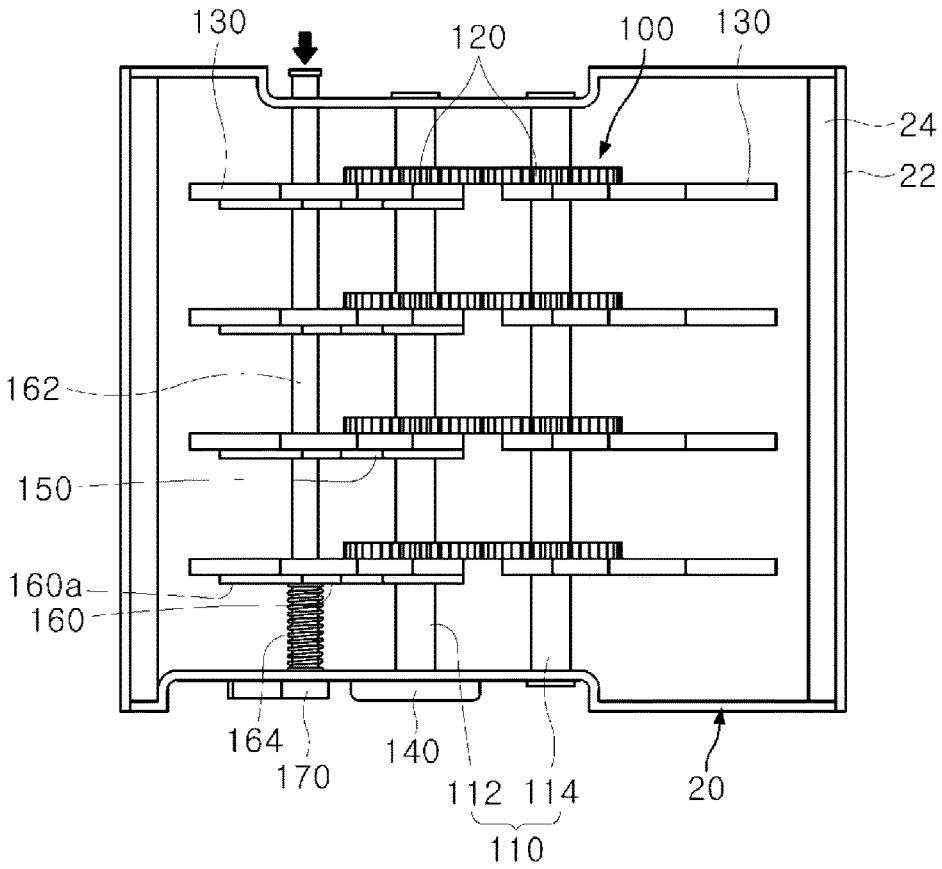
FIGS. 10 and 11 are plan views of FIGS. 4 and 5, respectively.
Figure 11:
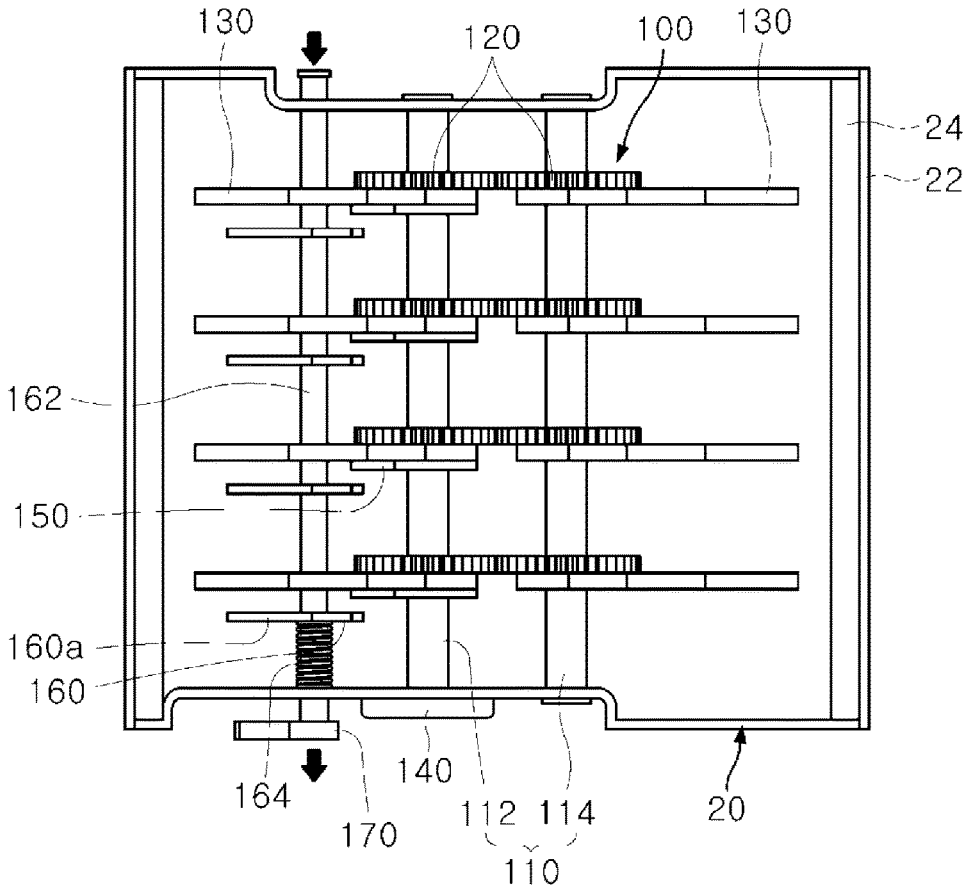

In addition, as illustrated in FIGS. 10 and 11, the stoppers 160 are positioned on the same horizontal line as the ratchets 150 due to the tension of the elastic spring 164 to remain engaged with the ratchets 150. In addition, when the rear end of the support shaft 162 is pushed forward or the lever 170 is pulled, the support shaft 162 is displaced forward along with the elastic spring 164 being compressed, so that the stoppers 160 disposed on the support shaft 162 are also displaced forward, thereby moving away from the same horizontal line as the ratchets 150. When force of pushing the support shaft 162 or pulling the lever 170 in the position is released, the support shaft 162 returns to the original position due to the restoring force of the elastic spring 162, whereby the stoppers 160 engage with the ratchets 150, as illustrated in FIG. 10.

For reference, the lifting members 130 disposed on the first driving shaft 112 have recesses 132 having a predetermined size such that the lifting members 130 in the horizontal position avoid interfering with the support shaft 162.

Seating portions 24 are formed on the inner surfaces of both walls of the base 20, the cover 30 is seated on the seating portions 24, and the cushion 40 is seated on the cover 30.

Figure 6:
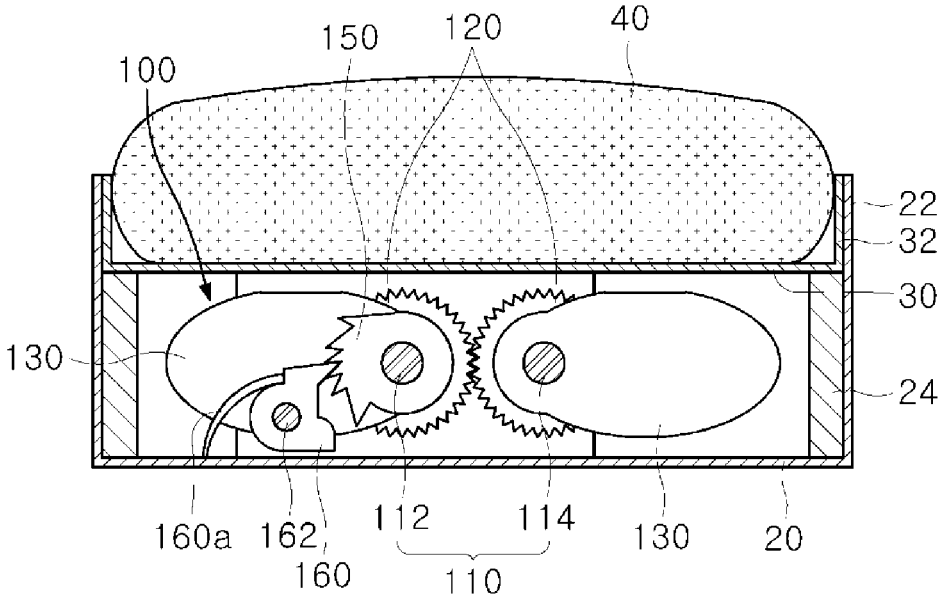
FIGS. 6 and 7 are front cross-sectional views illustrating the height-adjustable pillow according to the first exemplary embodiment of the present invention.
Figure 7:
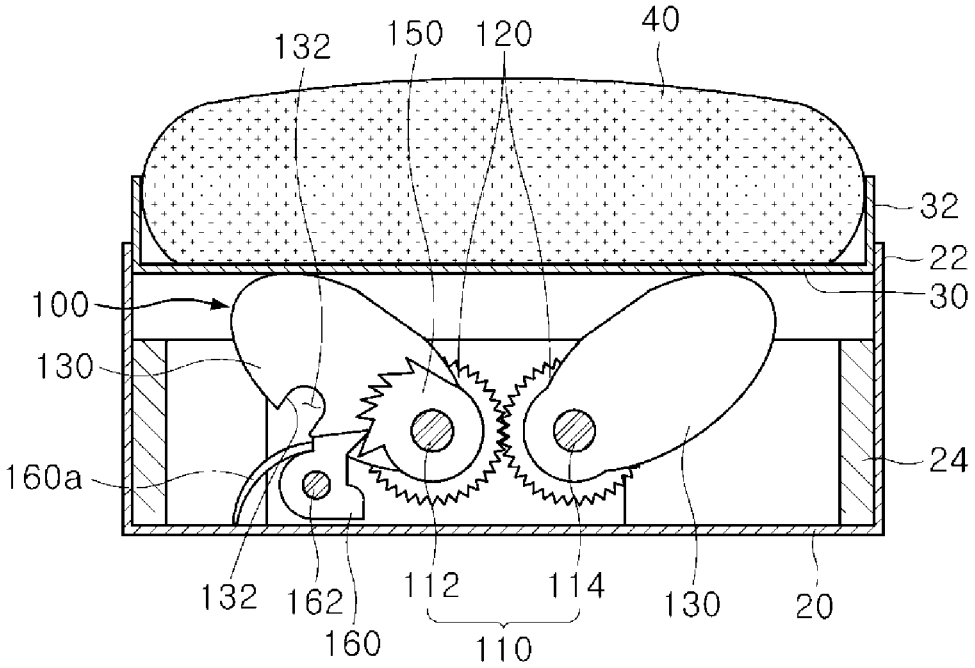
Figure 8:
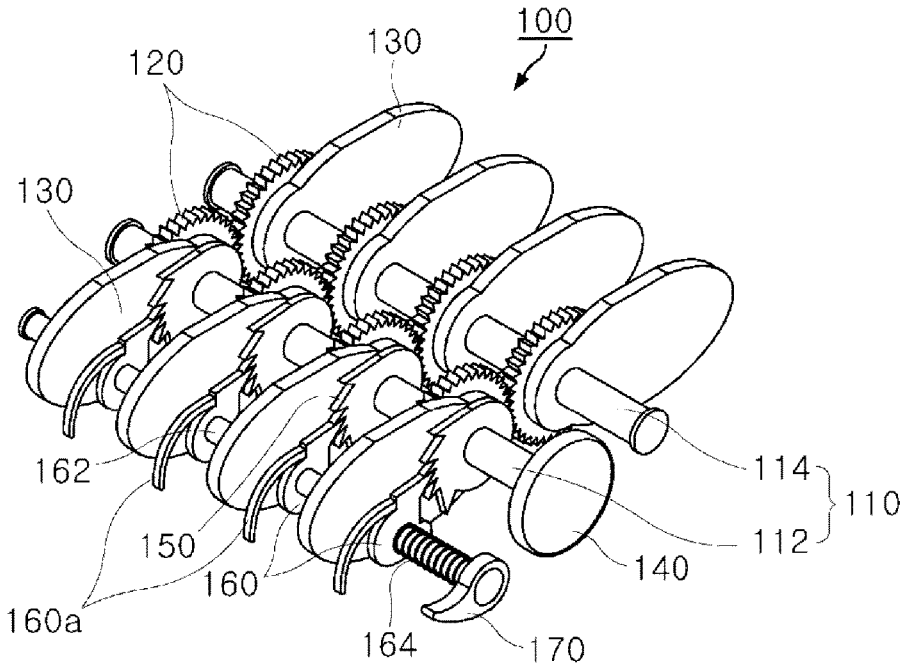
FIGS. 8 and 9 are perspective views illustrating the lift unit used in the height-adjustable pillow according to the first exemplary embodiment of the present invention.
Figure 9:
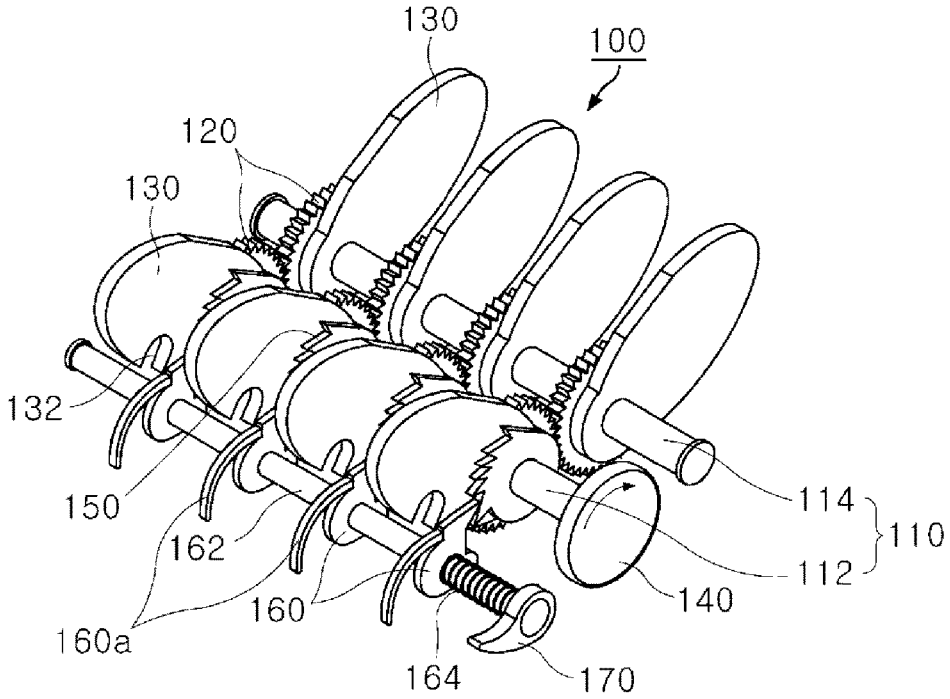

Thus, in the position in which the lifting members 130 are horizontal as in FIG. 6, the cover 30 is seated on the seating portions of the base 20. When the lifting members 130 are rotated in the vertical direction as illustrated in FIG. 7, the cover 30 is displaced upwards from the seating portions 24 of the base 20 by the lifting members 130.

For reference, guide projections 22 for guiding the lifting of the cover 30 in the vertical direction extend on the surfaces of both walls of the base 20, and prevention projections 32 for preventing the cushion 40 from derailing extend on the surfaces of both walls of the cover 30.

Figure 4:
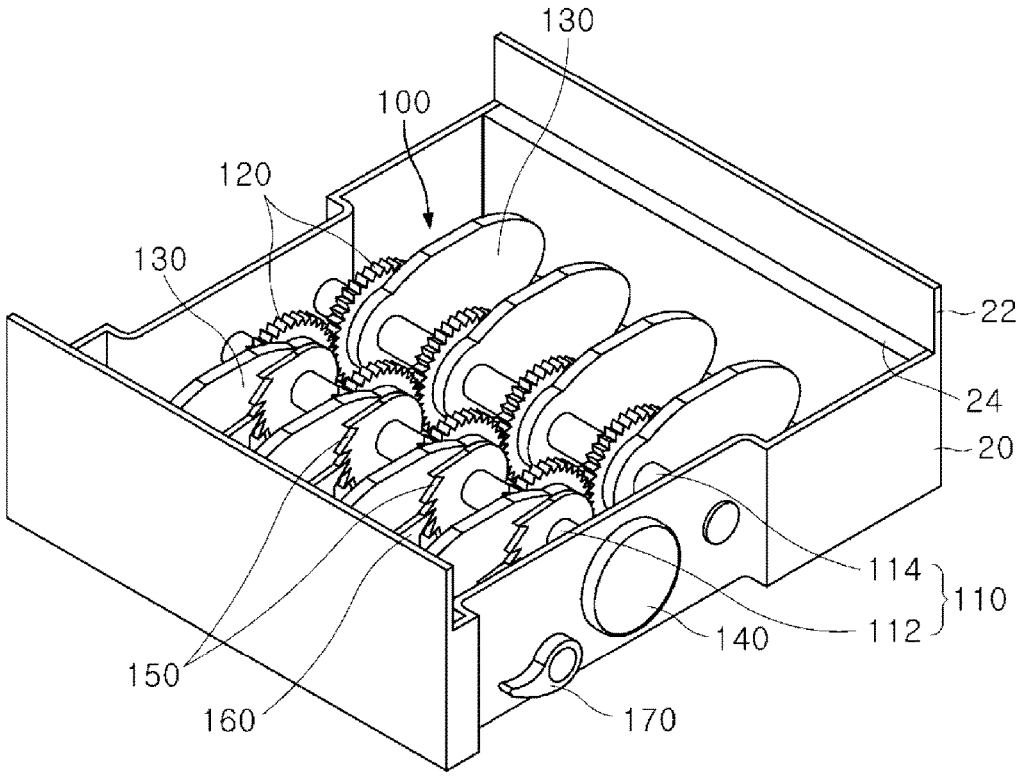
FIGS. 4 and 5 are perspective views illustrating the height-adjustable pillow shown in FIG. 3, from which the cover is removed.

The operational relationship of the height-adjustable pillow according to the first exemplary embodiment of the present invention will be described as follows:

First, as illustrated in FIGS. 4 and 6, in the position in which the lifting members 130 are seated on the seating portions of the base 20 and are in the horizontal positions, the height of the pillow remains in the lowest position.

Figure 2:
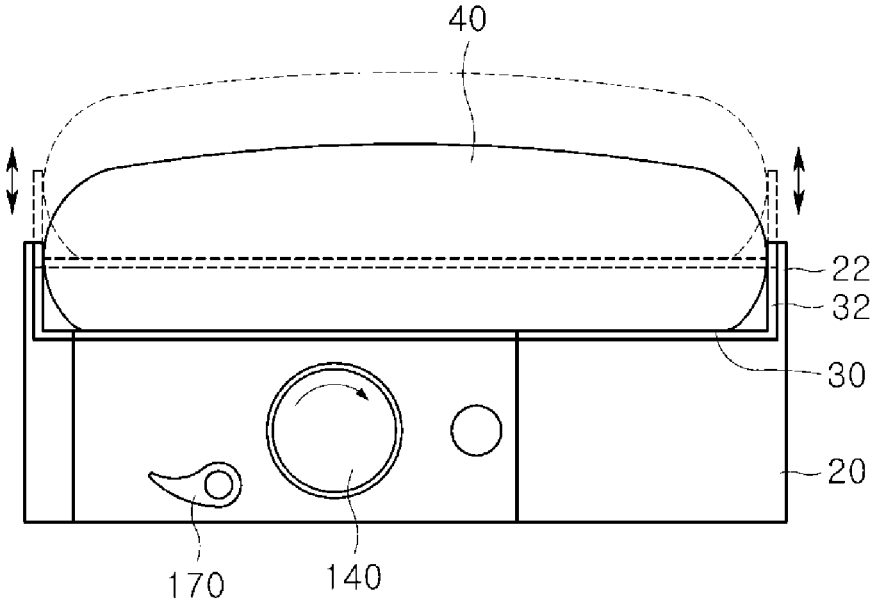
Figure 3:
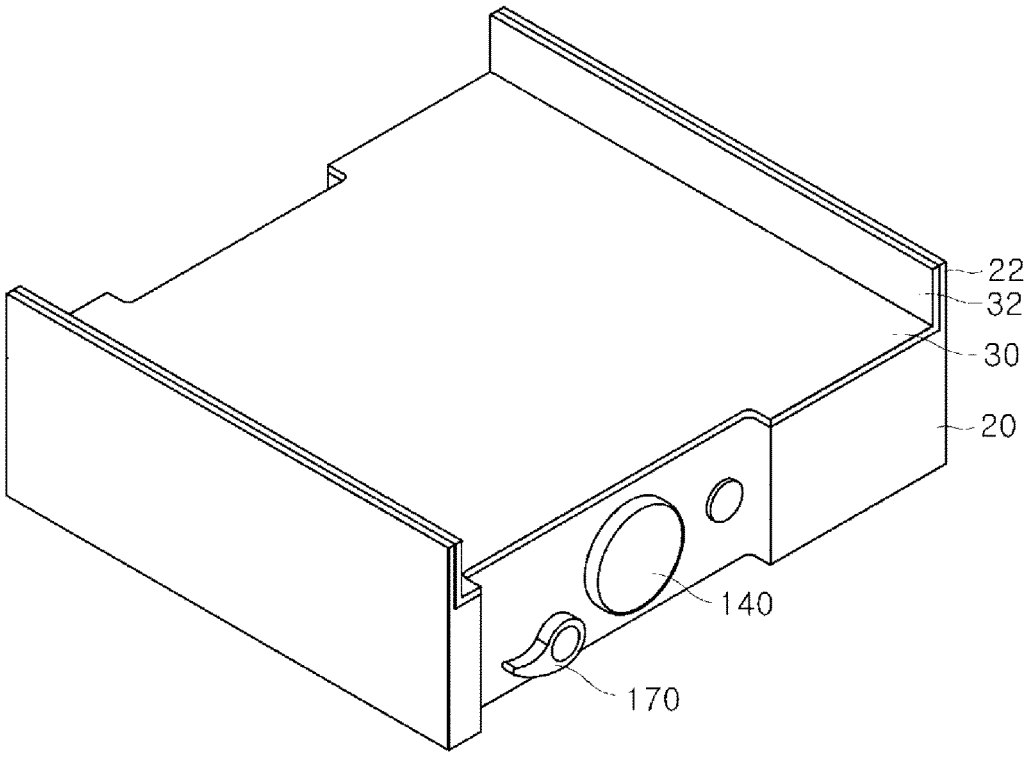
FIG. 3 is a perspective view illustrating the height-adjustable pillow shown in FIG. 1, from which the cushion is removed.
Figure 5:
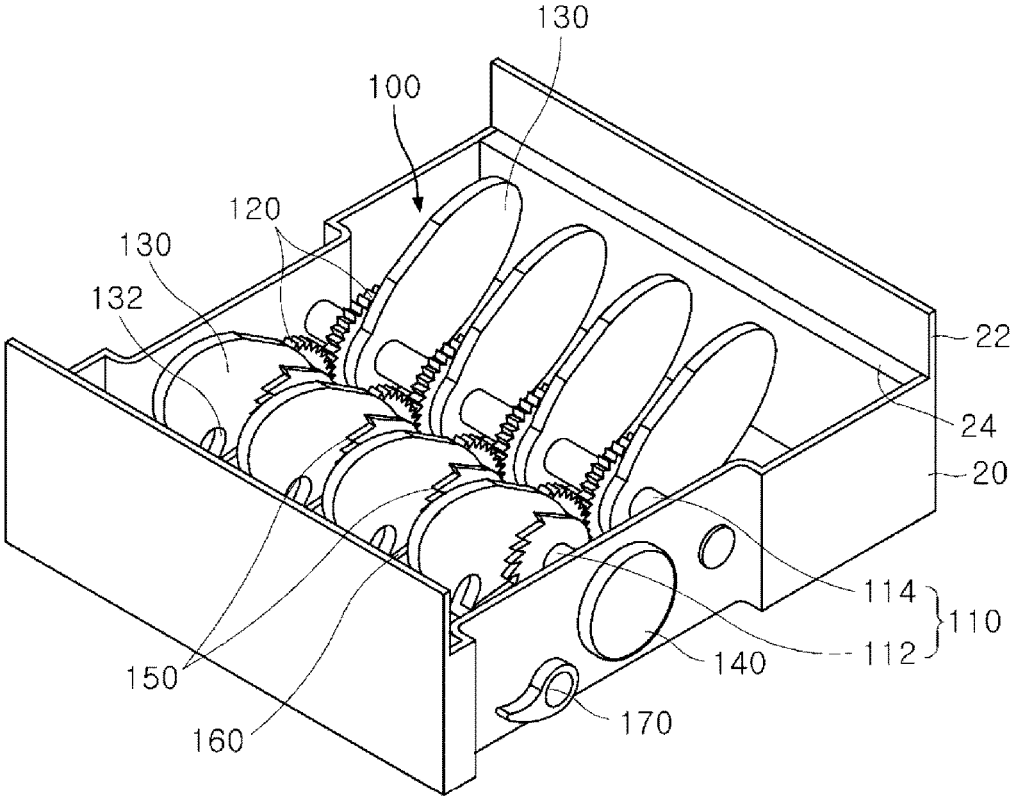

In this position, a user may rotate the handle 140 disposed on one end of one of the pair of driving shafts 110 in one direction to raise the height of the pillow. That is, as illustrated in FIG. 2, FIG. 5, and FIG. 7, when the handle 140 is rotated in one direction, the first driving shaft 112 on which the handle 140 is disposed rotates along with the handle 140, so that the ratchets 150 disposed on the first driving shaft 112 rotate in one direction on the stoppers 160. For example, when the handle 140 disposed on one end of the first driving shaft 112 is rotated to the right, the ratchets 150 disposed on the first driving shaft 112 responsively rotate to the right while clicking with the stoppers 160.

In this case, the elasticity of the stoppers 160 acts when the elastic members 160*a* are slightly pressed, allowing the ratchets 150 to rotate in one direction. Here, since the first driving shaft 112 is also rotated to the right, the lifting members 130 are also rotated together with the rotary gears 120, whereby the lifting members 130 are rotated from the horizontal positions to the vertical positions.

Since the rotary gears 120 of the first driving shaft 112 are meshed with the rotary gears 120 of the second driving shafts 1114, when the first driving shaft 112 rotates to the right, the second driving shaft 114 rotates to the left, the opposite direction. This consequently rotates the lifting members 130 disposed on the second driving shaft 114 from the horizontal positions to the vertical positions in the direction opposite to the direction in which the lifting members 130 disposed on the first driving shaft 112 are rotated.

As the lifting members 130 on both sides are vertically rotated as described above, the lifting members 130 displace the cover 30 upwards, so that the cushion 40 seated on the cover 30 is displaced upwards, thereby raising the height of the pillow.

In this position, when the head is placed on the cushion 40 so that load is applied to the cushion 40 and the cover 30, the ratchets 150 remain in the fixed positions held by the stoppers 160. This consequently prevents the pair of driving shafts 110 from rotating in the opposite direction, whereby the height of the cushion 40 is maintained.

Thus, the user can gradually raise the height of the cushion 40 to a desirable height using one-way rotation of the handle 140.

In the case of attempting to lower the height of the cushion 40 from the position in which the height of the cushion 40 has been raised as described above, the ratchets 150 and the stoppers 160 are unfixed, and then the handle 140 is rotated to the left, the opposite direction. That is, as illustrated in FIGS. 10 and 11, when the rear end of the support shaft 162 is pushed forwards or the lever 170 disposed on the front end of the support shaft 162 is pulled, the stopper disposed on the front end of the support shaft 162 is displaced a predetermined distance in the longitudinal direction while compressing the elastic spring 164. Consequently, the stoppers 160 are moved away from the same horizontal line as the ratchets 150, whereby the ratchets 150 are released to rotate to the left, in the opposite direction.

Thus, when the handle 140 is rotated to the left in this position, the first driving shaft 112 and the rotary gears 120 are also rotated to the left, and at the same time, the lifting members 130 are rotated from the vertical positions to the horizontal positions. At this time, the second driving shaft 114 and the rotary gears 120 and the lifting members 130 disposed on the second driving shaft 114 are also rotated to the right.

Responsively, the cover 30 is slowly displaced downwards along with the lifting members 130 that rotate horizontally. When the downward displacement of the cover 30 is finished, the support shaft 162 is released from being pressed or the lever 170 is released from being pulled.

When the support shaft 162 is released from being pressed or pulled, the support shaft 162 is displaced to the original position in the longitudinal direction due to the restoring force of the elastic spring 164. In other words, the stoppers 160 are positioned on the same line as the ratchets 150 and remain engaged with the ratchets 150. In this position, it is possible to displace the cover 30 and the cushion 40 upwards again by rotating the handle 140.

For reference, in the first embodiment of the present invention, the ratchets 150 and the handles 140 have been described as being disposed on the first driving shaft 112 of the pair of driving shafts 110. Alternatively, the ratchets 150 and the handles 140 may be disposed on the second driving shaft 114. In this case, the support shaft 162 on which the stoppers 160 are disposed may be disposed to correspond to a portion on which the second driving shaft 114 is positioned.

Second Embodiment

A height-adjustable pillow according to a second exemplary embodiment of the present invention is illustrated in FIGS. 12 to 17.

Figure 12:
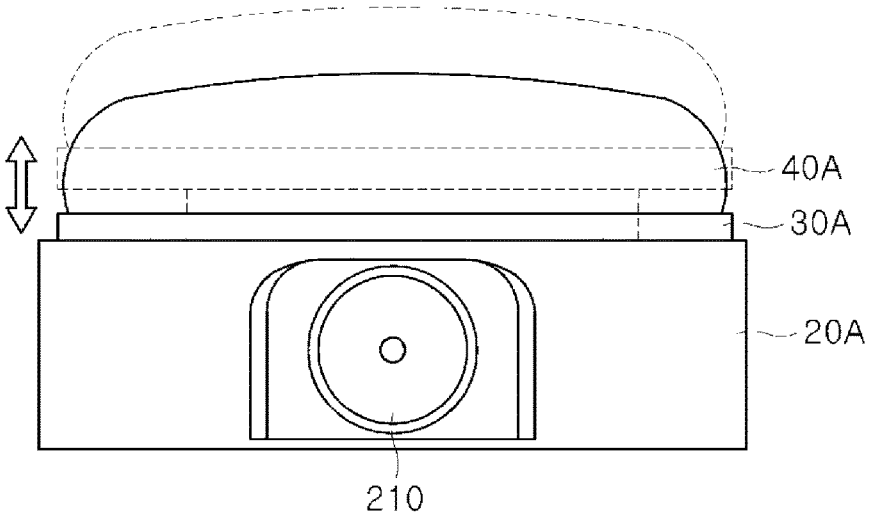
FIG. 12 is a front elevation view illustrating a height-adjustable pillow according to a second exemplary embodiment of the present invention.
Figure 13:
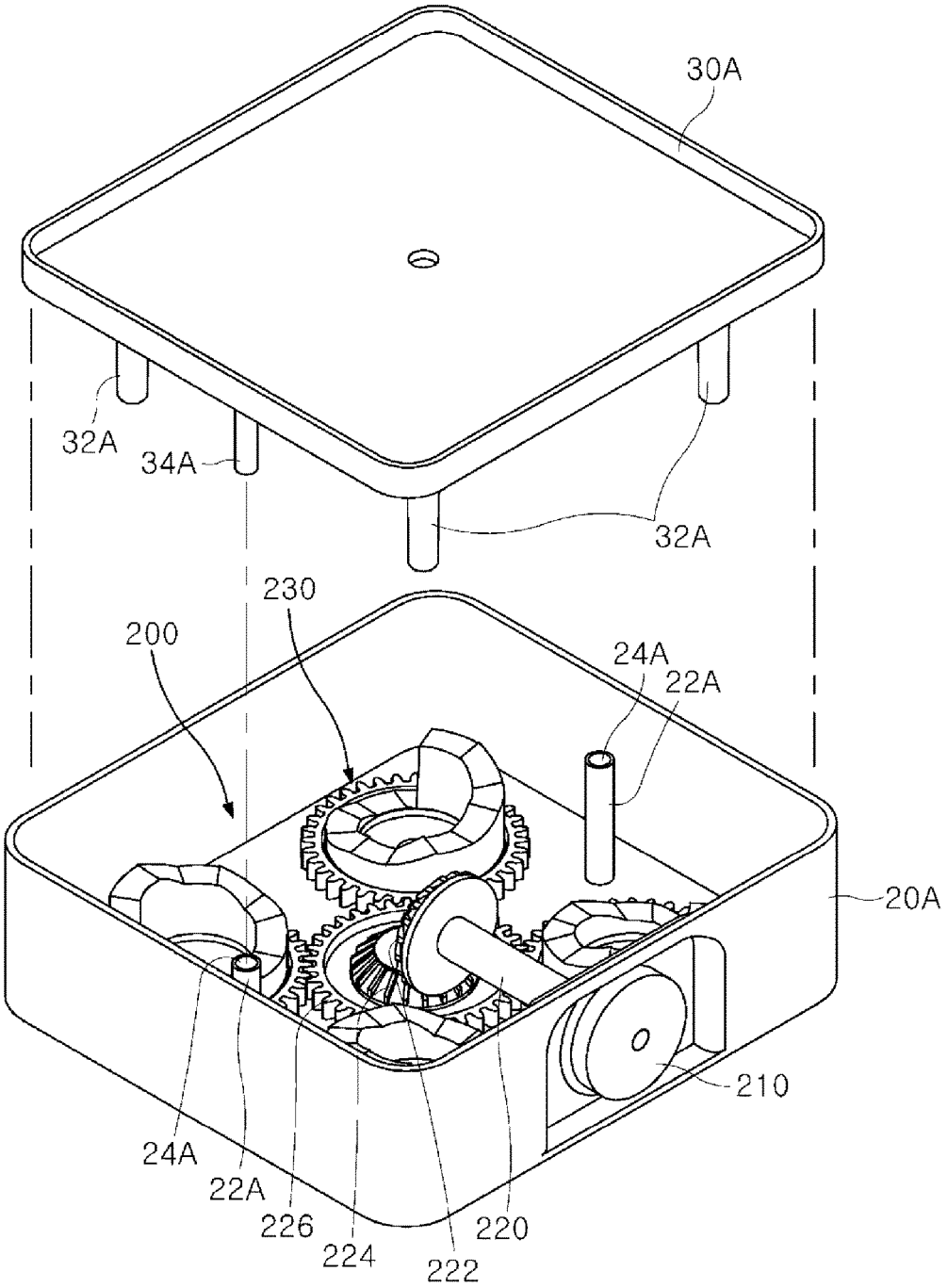
FIG. 13 is an exploded perspective view illustrating the height-adjustable pillow illustrated in FIG. 12, from which the cushion is removed.

As illustrated in FIGS. 12 and 13, the height-adjustable pillow according to the second exemplary embodiment of the present invention includes a base 20A, a cover 30A, and a lifting unit 200. The base 20A is a lower member in the shape of a box with the top surface thereof being open. The cover 30A is an upper member seated on the base 20A such that the cover 30A can be displaced up and down. The lifting unit 200 displaces the cover 30A up and down with respect to the base 20A. A cushion 40A is seated on the cover 30A to support the head. The cushion 40A is displaced up and down together with the cover 30A in response to the operation of the lifting unit 200.

Figure 14:
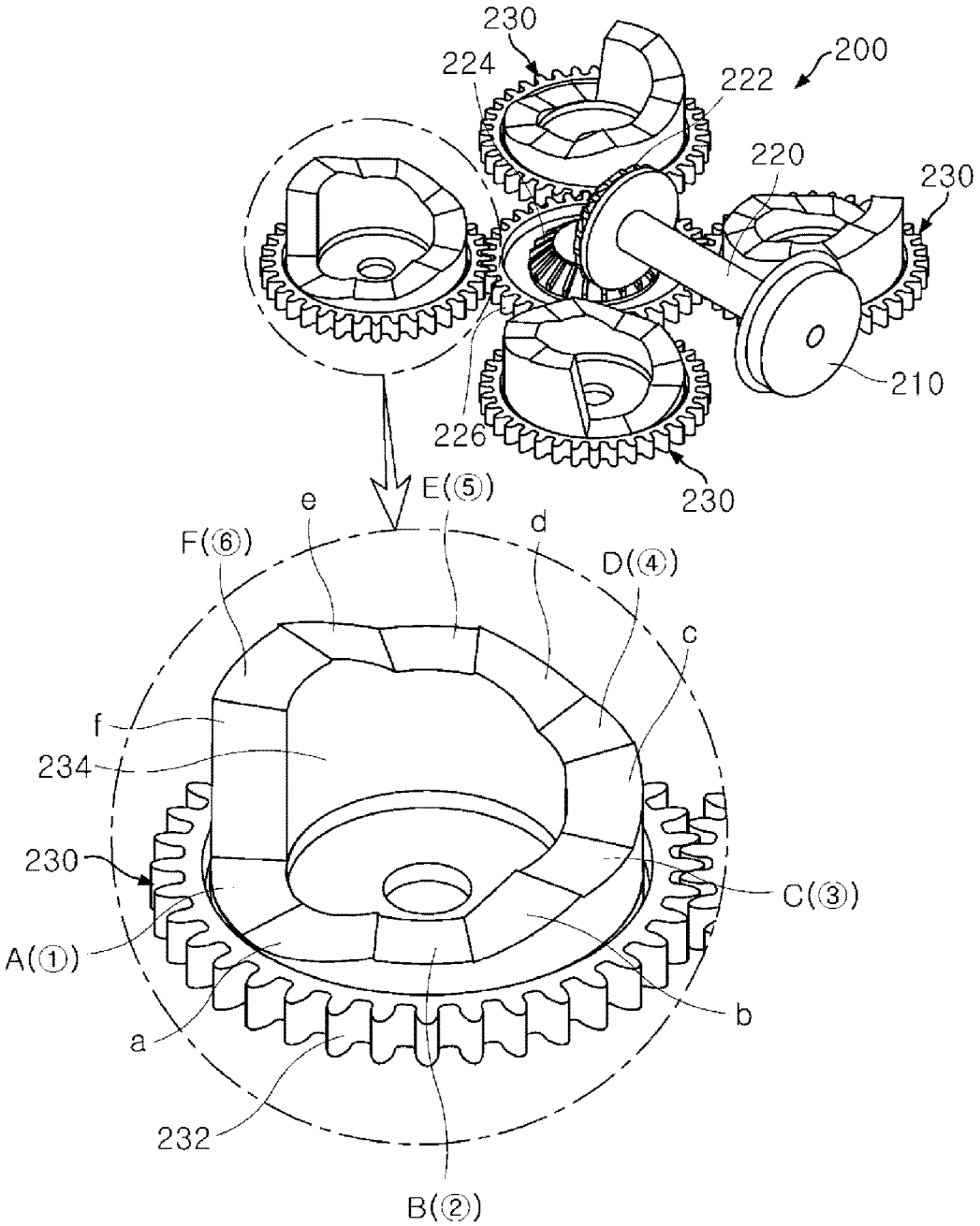
FIG. 14 is a perspective view illustrating the lifting unit used in the height-adjustable pillow according to the second exemplary embodiment of the present invention.

As illustrated in FIGS. 13 and 14, the lifting unit 200 includes a driving shaft 220 extending through one portion of the base 20A, a pinion gear (or driving bevel gear) 222 disposed on the distal end of the driving shaft 220, a ring gear (or driven bevel gear) 224 meshed with the pinion gear 222, a driving gear section (or driving spur gear) 226 rotating along with the ring gear 224, and a plurality of driven gear sections (or driven spur gears) 230 meshed and in concert with the driving gear section 226.

The pinion gear 222 disposed on the distal end of the driving shaft 220 and the ring gear 224 meshed with the pinion gear 222 form bevel gears to convert forward rotation of the driving shaft 220 into lateral rotation of the driving gear section 226. A handle 210 is disposed on the front end of the driving shaft 220 to be exposed externally from the base 20A. When the handle 210 is rotated, the driving shaft 220 is rotated, so that the bevel gears of the pinion gear 222 and the ring gear 224 are rotated. Consequently, the driving gear section 226 rotates, so that the drive gears sections 230 are responsively rotated. Lifting portions 234 are formed on the upper portions of the driven gears sections 230. Each of the lifting portions 234 is configured such that the height thereof changes in a stepwise manner along the circumference thereof.

The structure of the lifting portions 234 is illustrated in FIGS. 14 to 17. Each of the lifting portions 234 includes a first step portion A having a lowest height, a second step portion B with an upwardly-inclined first slope a formed between the first step portion A and the second step portion B, a third step portion C with an upwardly-inclined second slope b formed between the second step portion B and the third step portion C, a fourth step portion D with an upwardly-inclined third slope c being formed between the third step portion and the fourth step portion D, a fifth step portion E with an upwardly-inclined fourth slope c formed between the fourth step portion D and the fifth step portion E, a sixth step portion F with an upwardly-inclined fifth slope d formed between the fifth step portion E and the sixth step portion F, and a downwardly-inclined sixth slope f formed between the sixth step portion F and the first step portion A. In the second embodiment of the present invention, each of the lifting portions 234 has been described as having a stepped structure of a total six steps including the first step portion A to the sixth step portions F. However, each of the lifting portions 234 may have any stepped structure including two or more steps. The first step A to the sixth step F are disposed at equal distances from each other and are arranged radially around the driving gear section 226.

Contact members 32A are formed on the bottom surface of the cover 30A to be seated on the lifting portions 234 of the driven gears sections 230, respectively. Thus, as the driven gears sections 230 are rotated, the contact members 32A are positioned on the first step A to the sixth step F to be moved up and down. This will be described in detail later.

One or more guide pins 34A are formed on the bottom surface of the cover 30A and pin-receiving members 22A for guiding upward-downward movement of the guide pins 34A are formed on the base 20A in order to ensure that the contact members 32A are moved up and down in the vertical direction without being laterally derailed when the contact members 32A are moved up and down along with the rotation of the lifting portions 234 of driven gears sections 230. Each of the pin-receiving members 22A has a guide hole 24A allowing the corresponding guide pin 34A received therein to move up and down. Alternatively, pin-receiving members respectively having a guide hole may be formed on the cover 30A, and guide pins may be formed on the base 20A.

Figure 15:
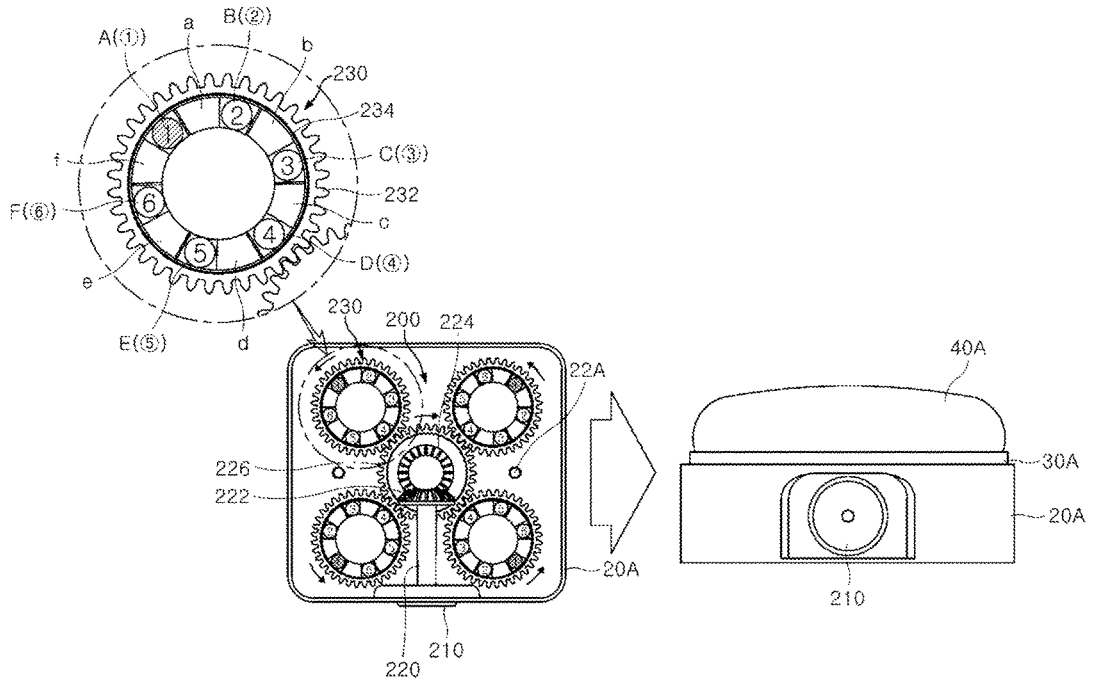
FIGS. 15 to 17 illustrate the operational relationship of the height-adjustable pillow according to the second exemplary embodiment of the present invention.

The operational relationship of the height-adjustable pillow according to the second exemplary embodiment of the present invention will be described as follows:

In the position in which the lifting unit 200 is disposed in the inner space of the base 20A and the cover 30A having the cushion 40A placed thereon is seated on the lifting unit 200, when the contact members 32A are positioned on the first step portions A of the driven gears sections 230 as illustrated in FIG. 15, the cover 30A and the cushion 40A remain in the lowest positions.

In this position, when the user rotates the handle in one direction as an attempt to raise the height of the pillow, the driving shaft 220 on which the handle 210 is disposed is rotated, so that the bevel gears consisting of the pinion gear 222 and the ring gear 224 rotate responsively.

Thus, the driving gear section 226 on which the ring gear 224 of the bevel gears is seated is rotated in one direction, so that the plurality of driven gears sections 230 meshed with the driving gear section 226 are also rotated in one direction. That is, since teeth of the driving gear section 226 are meshed with teeth 232 of the driven gears sections 230, the driven gears sections 230 are rotated along with the rotation of the driving gear section 226.

As the driven gears sections 230 are rotated as described above, the lifting portions 234 formed on the top portions of the driven gears sections 230 are also rotated, so that the contact members 32A are moved along the slopes to be positioned on the next higher step portions, thereby displacing the cover 30A upwards.

Figure 16:
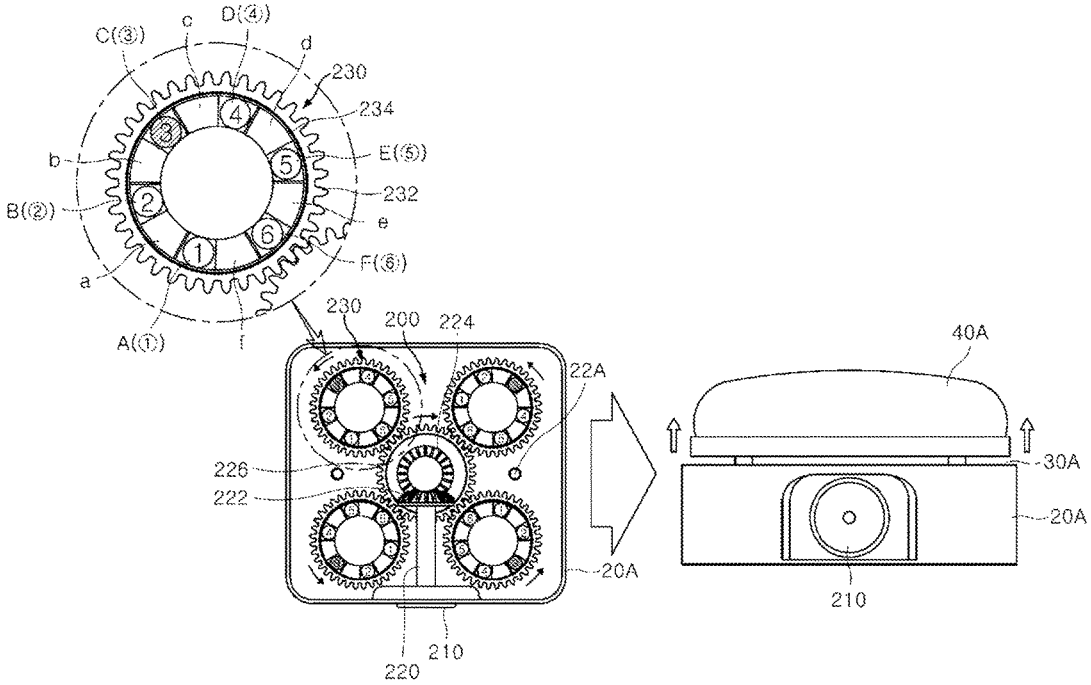

For example, as illustrated in FIG. 16, the driving shaft 220, the bevel gears, and the driving gear section 226 rotate in response to the rotation of the handle 210. This leads to the rotation of the driven gears sections 230, so that the lifting portions 234 are also rotated. When the third steps C are positioned on the bottoms of the contact members 32A, the cover 30A and the cushion 40A are moved upwards to a predetermined height. In this case, the contact members 32A are seated on the third step portions C after having moved along the first slopes a, the second step portions B, and the second slopes b.

Figure 17:
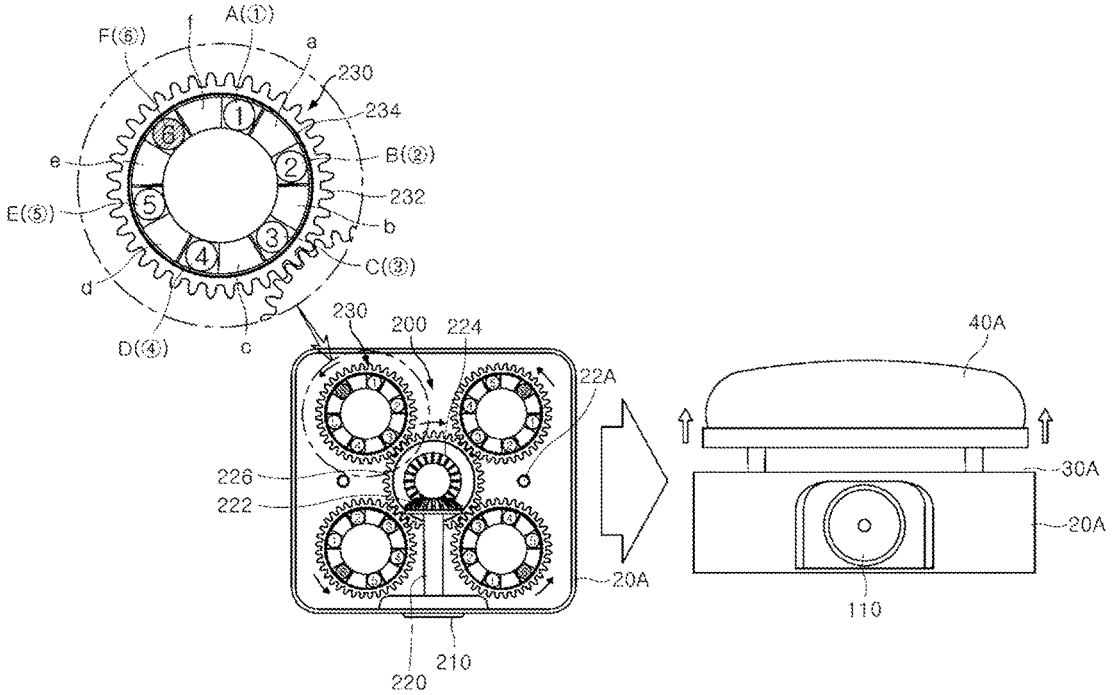

When the handle 210 is rotated further, as illustrated in FIG. 17, the contact members 32A are seated on the sixth step portions F after having moved along the third slopes c, the fourth step portions D, the fourth slopes d, and the fifth step portions E, and the fifth slopes e, in response to the rotation of the driving shaft 220, the bevel gears, the driving gear section 226, and the driven gears sections 230.

In the position in which the cover 30A and the cushion 40A have been moved to the height positions as described above, when the handle 20A is rotated further, the contact members 32A move downwards along the sixth slopes f in response to the rotation of the driving shaft 220, the bevel gears, the driving gear section 226, and the driven gears sections 230 to be seated on the first step portions A. Consequently, the cover 30A and the cushion 40A are in the lowest positions, as illustrated in FIG. 15.

For reference, the second embodiment of the present invention has described that the heights of the cover 30A and the cushion 40A are raised as the contact members 32A moved from the lowest step portions to the higher step portions of the lifting portions 234 in response to the handle 210 being rotated. Alternatively, the second embodiment of the present invention may be configured such that the heights of the cover 30A and the cushion 40A are lowered as the contact members 32A move from the higher step portions to the lower step portions of the lifting portions 234 in response to the handle 210 being rotated in the opposite direction.

In addition, each of the lifting portions 234 formed on the top portions of the driven gears sections 230 as illustrated in FIG. 14 may have projections (not shown) on boundaries between the step portions A to F and the slopes a to f, each of the projections protruding a predetermined height from the corresponding step portion, such that the contact members 32A cannot move from a higher step portion to a lower step portion of the lifting portion 234 along the slopes a to f of the lifting portion 234 unless external force having a predetermined intensity is applied.

Third Embodiment

A height-adjustable pillow according to a third exemplary embodiment of the present invention is illustrated in FIGS. 18 to 22.

Figure 18:
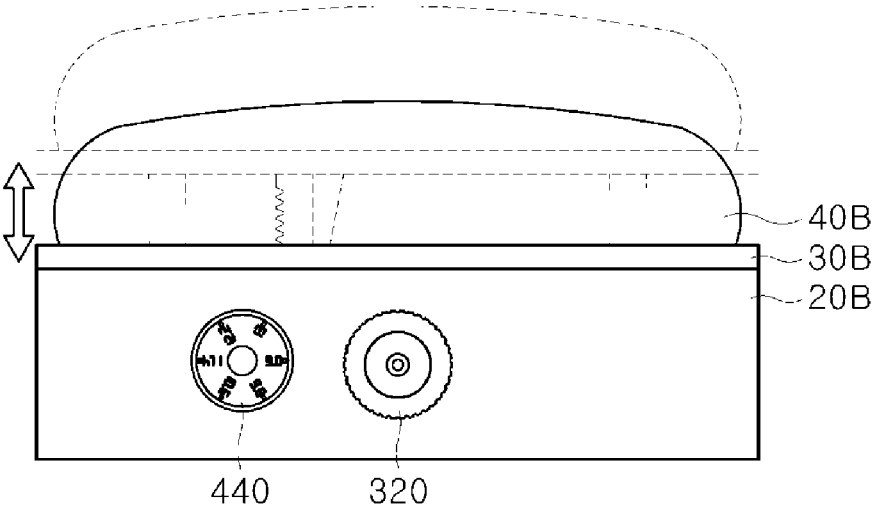
FIG. 18 is a front elevation view illustrating a height-adjustable pillow according to a third exemplary embodiment of the present invention.
Figure 19:
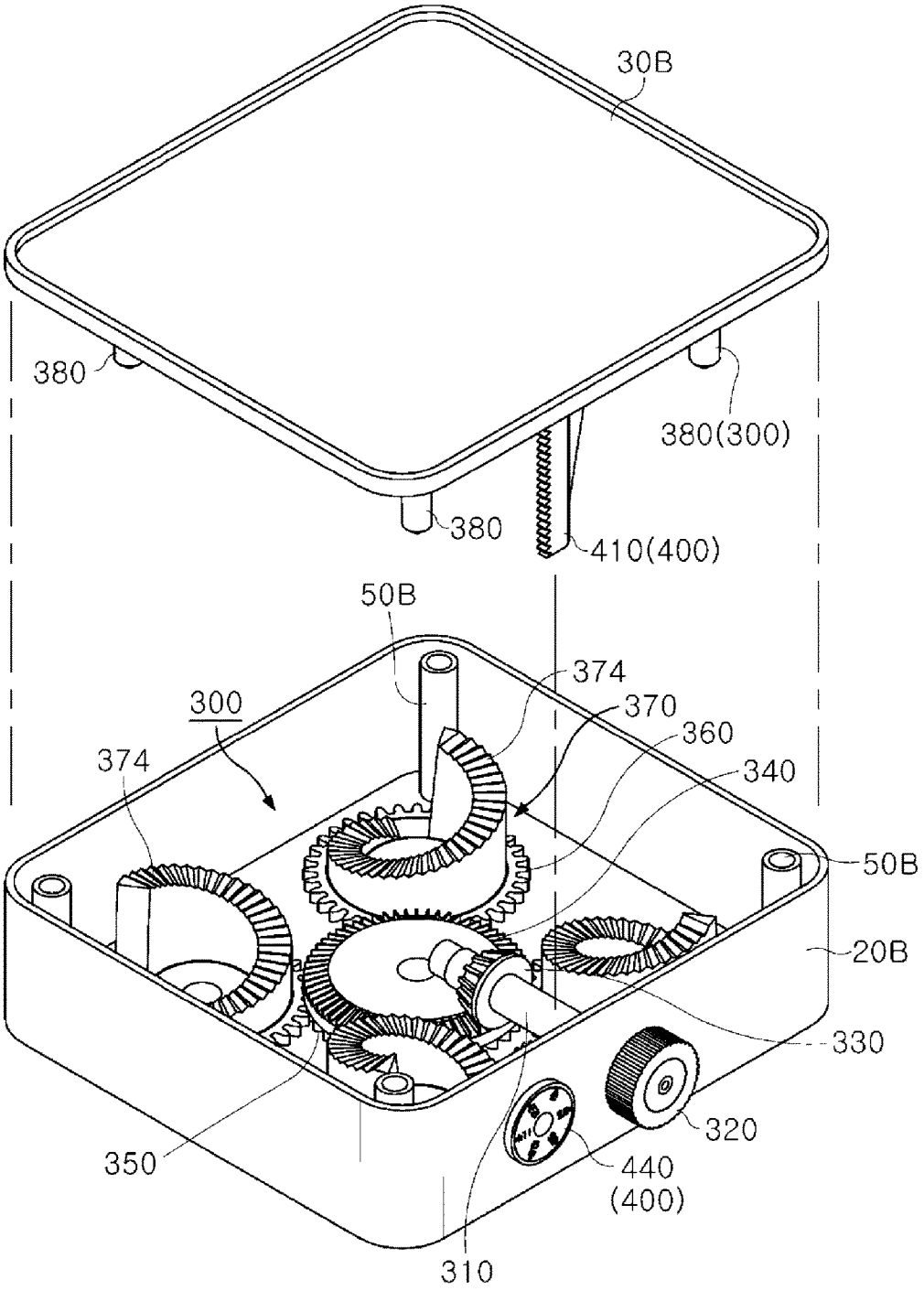
FIG. 19 is an exploded perspective view illustrating the height-adjustable pillow illustrated in FIG. 18, from which the cushion is removed.

As illustrated in FIGS. 18 and 19, the height-adjustable pillow according to the third exemplary embodiment of the present invention includes a base 20B and a cover 30B. The base 20B is a lower member in the shape of a box with at least a portion of the top surface thereof being open. The cover 30B is an upper member seated on the base 20B such that the cover 30B can be displaced linearly up and down. The base 20B and the cover 30B form a pillow body. The height-adjustable pillow according to the third exemplary embodiment further includes a lifting unit 300 displacing the cover 30B up and down with respect to the base 20B to adjust the height of the cover 30B. A cushion 40A is provided on the cover 30 to elastically support the head. Thus, the cushion 40A is displaced up and down together with and in the same direction as the cover 30B in response to the operation of the lifting unit 300.

Figure 20:
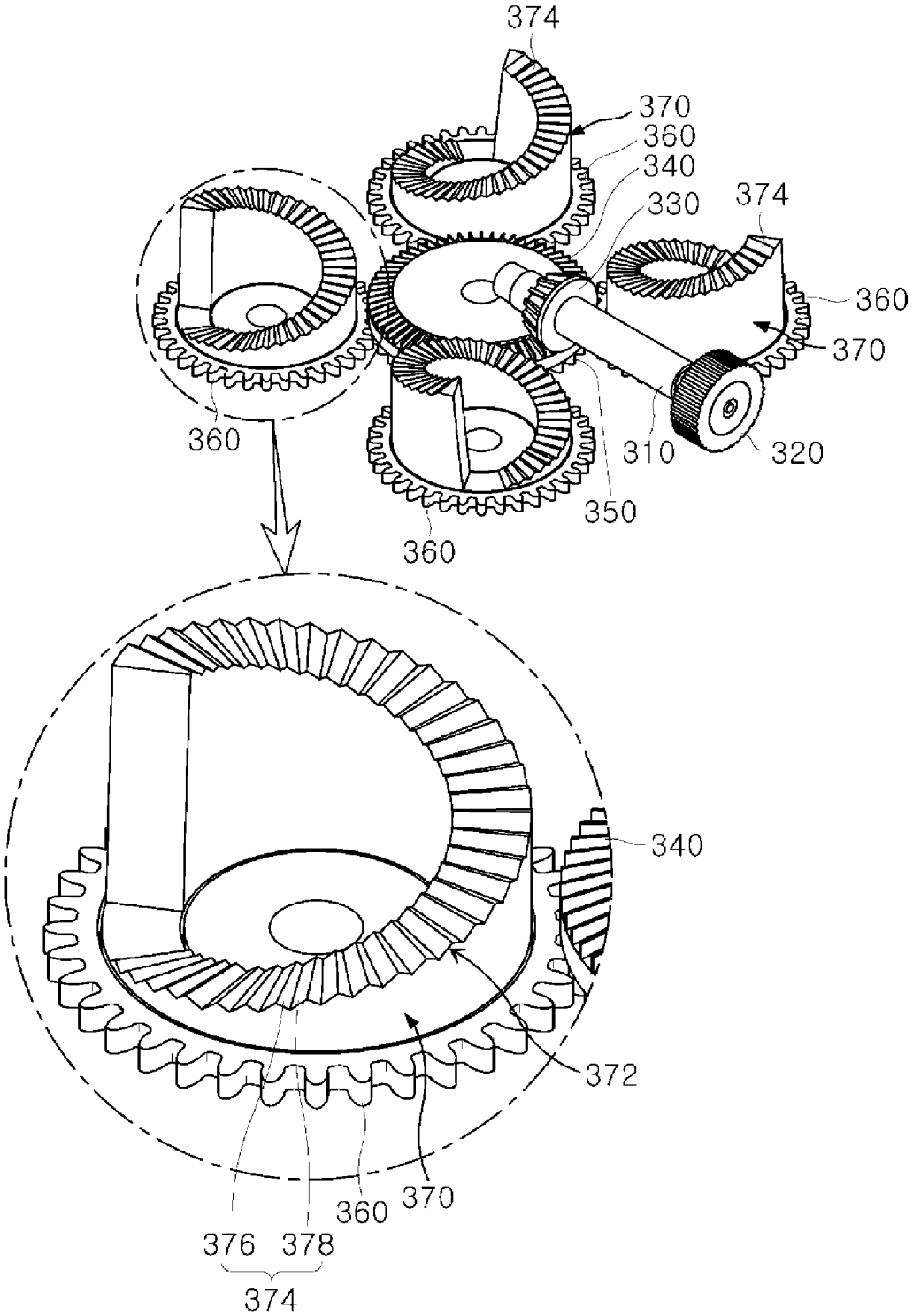
FIG. 20 is a perspective view illustrating the lifting unit used in the height-adjustable pillow according to the third exemplary embodiment of the present invention.

As illustrated in FIGS. 19 and 20, the lifting unit 300 includes a driving shaft 220 extending through a wall (e.g. a front wall) of the base 20B. The driving shaft 220 is arranged horizontally to be rotatable. The lifting unit 300 further includes a driving bevel gear 330 disposed on the driving shaft 310 in the inner space of the base 20B, a driven bevel gear 340 meshed with the driving bevel gear 330, a driving spur gear 350 disposed coaxially with the driven bevel gear 340, and a single or plurality of driven spur gears 360 meshed with the driving spur gear 350. A handle 210 is disposed on the driving shaft 310 outside of the base 20B. The driving spur gear 350 is disposed on the bottom of the base 20B. The driven spur gears 360 are provided in a plural number. The driven spur gears 360 are arranged around the driving spur gear 350 and are mounted on the bottom of the base 20B. The driven bevel gear 340 is disposed on the driving spur gear 350.

When the handle 320 is rotated, the driving bevel gear 330 is rotated along with and in the same direction as the driving shaft 310. The driven bevel gear 340 and the driving spur gear 350 are simultaneously rotated about the axis extending in the vertical direction, and the driven spur gears 360 are also driven about the top-bottom axis.

The configuration of the height-adjustable pillow according to the third exemplary embodiment as described above is substantially identical or similar to the configuration according to the second embodiment.

Figure 21:
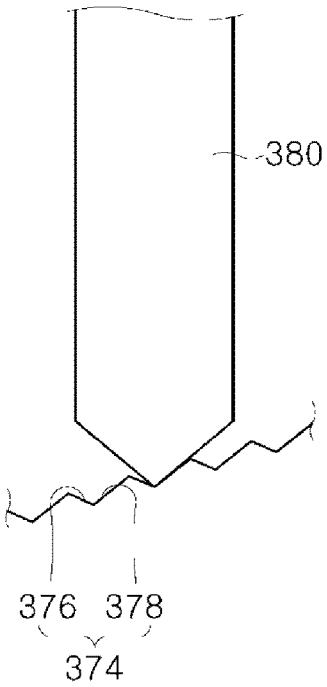
FIG. 21 is a configuration view illustrating portions of the lifting unit illustrated in FIG. 20.

As illustrated in FIGS. 20 and 21, the lifting unit 300 further includes rotary members 370 disposed on the driven spur gears 360 to rotate along with the driven spur gears 360, respectively, and contact members 380 protruding from the cover 30 in the direction of the rotary members 370. Here, the contact members 380 function similarly to the contact members 32A according to the second embodiment.

Each of the rotary members 370 has a slope 372 on the top portion thereof, the slope 372 being upwardly inclined in one direction (i.e. counterclockwise in the drawing) along the circumference about the axis of the underlying driven spur gear 360. Holding step portions 374 are formed on the slope 372, continuously along the length of the slope 372, such that the holding step portions 374 are positioned at different heights.

The distal end of each of the contact members 380 is in contact with one of the holding step portions 374, depending on the angle of rotation of the rotary member 370.

Each of the holding step portions 374 includes a stepped surface 376 and a connecting surface 378. In each of the slopes 732, the stepped surfaces 376 are arranged at predetermined distances along the length of the slope 372 such that the stepped surfaces 376 are spaced apart and positioned at different heights from each other. The connecting surfaces 378 are formed as inclined surfaces connecting the stepped surfaces 376 that are at different heights. With this configuration, when the rotary member 370 is rotated, the contact member 380 is moved up or down while coming into contact with the stepped surfaces from one to an adjacent one.

The stepped surfaces 376 are inclined downwardly in one direction along the circumference about the axis of the underlying driven spur gear 360 in order to prevent the contact member 380 from being unintentionally moved along with the connecting surfaces 378.

Although not specifically illustrated, the height-adjustable pillow according to the third exemplary embodiment of the present invention may include a guide for guiding upward and downward displacement of the cover 30B. The guide may include one or more guide pins (not shown) protruding downward from the cover 30B and pin-receiving members 50B formed on the base 20B, each of the pin-receiving members 50B having a guide hole in which the corresponding guide pin is received. Alternatively, the positions of the guide pins may be exchanged with the positions of the pin-receiving members 50B. Here, the functions of the guide pins and the pin-receiving members 50B are substantially identical or similar to the functions of the guide pins 34A and the pin-receiving members 22A according to the second embodiment.

The operational relationship of the height-adjustable pillow according to the third exemplary embodiment of the present invention will be described as follows:

When the contact members 380 are positioned on the stepped surfaces 376 of the holding step portions 374, the cover 30B remains in the lowest position.

In this position, when the handle 320 is rotated counterclockwise in the drawing of FIG. 20, the driving bevel gear 330, the driven bevel gear 340, the driving spur gear 350, and the driven spur gears 360 are rotated together with the driving shaft 310. At the same time, the driven spur gears 360 are rotated clockwise in the drawing of FIG. 20. Then, the contact members 380 are moved upwards along the inclined connecting surfaces 378 of the lowest holding step portions 374 to be positioned on the stepped surfaces 376 of the higher step portions next to the lowest holding step portions 374, so that the cover 30B is set to a one-step higher height.

When the handle 320 is rotated continuously in the same direction, the height of the cover 30B is continuously raised. In contrast, when the handle 320 is rotated in the opposite direction, the contact members 380 are positioned on the stepped surfaces of the lower holding step portions, so that the height of the cover 30B is lowered.

Figure 22:
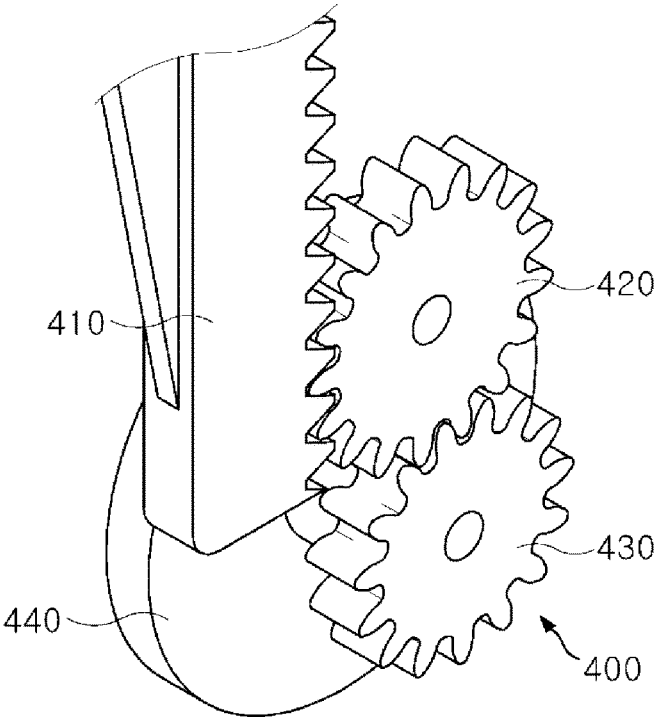
FIG. 22 is a perspective view illustrating the height adjusting unit used in the height-adjustable pillow according to the third exemplary embodiment of the present invention.

Reference numeral 400 in FIG. 22 indicates an indicating unit that indicates the height of the cover 30B that has been moved up or down by the lifting unit 300.

Referring to FIGS. 18 and 19 together with FIG. 22, the indicating unit 400 includes a rack 410 extending downward from the cover 30B to be positioned within the base 20B, a pinion 420 disposed within the base 20B to be meshed with the rack 410, an operating gear 430 disposed within the base 20B to be meshed with the pinion 420, and an indicating member 440 disposed outside of the base 20B. The indicating member 440 is mounted on the shaft of the operating gear 430 to rotate along with the operating gear, and has a height indicating portion. Although not illustrated, a pointer may be provided in a portion of the base 20B adjacent to the indicating portion, such that the pointer represents the height indicated by the indicating portion of the indicating member 440.

In the indicating unit 400, as the cover 30B is displaced up and down, the rack 410 is moved up and down along with and in the same direction as the cover 30B, thus rotating the pinion 420 and the operating gear 430. Consequently, the indicating member 440 is rotated, thereby indicating the height of the cover 30B that has been displaced up and down. Here, the user can adjust the height of the cover 30B while visually recognizing the height of the cover 30B that has been displaced up and down through the height indicating portion.

Although the present invention has been described for illustrative purposes, the present invention is not limited to the disclosed embodiments and accompanying drawings. Those skilled in the art will appreciate that various modifications are possible without departing from the scope and spirit of the present invention as disclosed in the accompanying claims. In addition, technical concepts described with respect to the embodiments of the present invention may be carried out alone or two or more thereof may be combined.

What is claimed is:

1. A height-adjustable pillow comprising:

a lower member;

an upper member disposed on the lower member, the upper member being displaceable up and down with respect to the lower member; and a lifting unit adjusting a height of the upper member by displacing the upper member, wherein the lifting unit comprises:

a rotary member provided on a surface of one of the lower member and the upper member that faces the other of the lower member and the upper member such that the rotary member is rotatable about a vertical axis, the rotary member comprising a slope upwardly inclined in one direction along a circumference thereof about the axis and a plurality of holding step portions formed on the slope to continuously extend along a length of the slope such that the plurality of holding step portions are positioned at different heights; and a contact member provided one the other one of the lower member and the upper member such that the contact member is able to come into contact with one of the plurality of holding step portions depending on an angle of rotation of the rotary member, wherein each of the plurality of holding step portions comprises a stepped surface and a connecting surface, the stepped surfaces of the plurality of holding step portions are arranged at predetermined distances in the length of the slope such that the stepped surfaces are spaced apart and positioned at different heights from each other, and the connecting surfaces of the plurality of holding step portions comprise inclined surfaces connecting the stepped surfaces having different heights, respectively, such that the contact member is displaced up and down along one of the connecting surfaces to move to an adjacent one of the stepped surfaces when the rotary member is rotated.

2. The height-adjustable pillow according to claim 1, wherein each of the stepped surfaces is downwardly inclined in one direction along the circumference about the axis.

3. The height-adjustable pillow according to claim 1, further comprising a guide for guiding upward and downward displacement of the upper member, wherein the guide comprises a guide pin and a pin-receiving member having a guide hole in which a guide pin is received, the guide pin being provided on one of the upper member and the lower member, and the pin-receiving member being provided on the other of the upper member and the lower member.

4. The height-adjustable pillow according to claim 1, further comprising an indicating unit for indicating a height of the upper member determined by the lifting unit.

5. The height-adjustable pillow according to claim 4, wherein the indicating unit comprises:

a rack extending vertically downward from the upper member;

a pinion meshed with the rack; and an indicating member disposed outside of the lower member to rotate along with the pinion, the indicating member having a height indicating portion.

* * * * *